US005533868A

United States Patent [19]

Fassbender

[11] Patent Number: 5,533,868

[45] Date of Patent: Jul. 9, 1996

[54] APPARATUS AND METHOD FOR BATCH-WIRE CONTINUOUS PUMPING

[75] Inventor: Alexander G. Fassbender, West Richland, Wash.

[73] Assignee: Battelle Memorial Institute, Richland, Wash.

[21] Appl. No.: 394,085

[22] Filed: Feb. 24, 1995

[51] Int. Cl.[6] ..... F04B 9/08

[52] U.S. Cl. ..... 417/53; 417/103; 417/390

[58] Field of Search ..... 417/103, 102, 417/390, 53

[56] References Cited

U.S. PATENT DOCUMENTS 2,419,993 5/1947 Green et al. ..... 417/390 X 3,749,526 7/1973 Ferrentino ..... 417/390

4,304,527 12/1981 Jewell et al. ..... 417/103 X 4,536,131 8/1985 Saito et al. ..... 417/103 X

*Primary Examiner*—Richard E. Gluck

*Attorney, Agent, or Firm*—Paul W. Zimmerman

[57] ABSTRACT

The apparatus of the present invention contains at least one pressure vessel having a separator defining two chambers within each pressure vessel. The separator slideably seals the two chambers. Feedstock is placed within a second chamber adjoining the first chamber via a feedstock pump operating in a high volume low head mode. A pressurizer operates in a low volume high pressure mode to pressurize the working fluid and the feedstock in the pressure vessels to a process operating pressure. A circulating pump operates in a high volume, low head mode to circulate feedstock through the process. A fourth pump is used for moving feedstock and product at a pressure below the process operating pressure.

10 Claims, 15 Drawing Sheets

APPARATUS AND METHOD FOR BATCH-WIRE CONTINUOUS PUMPING

FIELD OF THE INVENTION

The present invention relates generally to an apparatus and method for batch-wise continuous pumping. More specifically the apparatus and method permit operation of a continuous or semi-continuous process and maintaining pressure of the process while introducing a new feedstock or while removing a processed product.

BACKGROUND OF THE INVENTION

In processes requiring pressurization of substantially incompressible fluids, for example water, or aqueous solutions or slurries, fluid handling equipment is generally sized according to a maximum desired throughput at the maximum specified pressures. It is understood by those skilled in the art of sizing fluid handling equipment that pressurization may be the result of mechanical pumping, hydraulic head, thermal heating, or a combination thereof. For high volume flow operations, high volume flow high head pumps are needed to simultaneously pressurize and move the volume flow through processing stages. Product is typically released from process pressures by use of a throttling valve.

It is therefore an object of the invention to provide an apparatus and method that permits operation of a continuous or semi-continuous process at an elevated pressure while permitting addition of feedstock or removal of product while maintaining stable process conditions.

SUMMARY OF THE INVENTION

The apparatus and method of the present invention exploit the characteristics of substantially incompressible liquid that permit pressurization of the liquid separately from flow or circulation of the liquid.

The apparatus of the present invention preferably contains a pair of pressure vessels wherein each pressure vessel has a separator defining two chambers within each pressure vessel. The separator slideably seals the two chambers. Working fluid is preferably placed within a first chamber either by gravity feed or pumping. Feedstock is placed within a second chamber adjoining the first chamber via a feedstock pump operating in a high volume flow low head mode. A pressurizer operates in a low volume flow high pressure mode to pressurize the working fluid and the feedstock in the pressure vessels to a process operating pressure. A circulating pump then operates in a high volume, low head mode to circulate feedstock through the process. A third pump may be used for transferring feedstock and product at a pressure below the process operating pressure.

The method of the present invention begins with the step of providing at least one pressure vessel, and preferably at least a pair of pressure vessels, wherein each pressure vessel has a separator defining first and second chambers within the pressure vessel to prevent fluid communication between a working fluid and either of a feedstock or product within the pressure vessel. A first chamber within one of the pressure vessels is filled with the feedstock, and a second chamber within the same pressure vessel is filled with a working fluid so that the pressure vessel is substantially filled with feedstock and working fluid. A top chamber in the other of the pair of pressure vessels is filled with working fluid while a bottom chamber retains a small amount of product to permit pressurization. A pressurizer operates in a low volume flow high pressure mode to pressurize the pair of pressure vessels to a process operating pressure. After reaching process pressure, the pressurizer is isolated and a circulating pump operates in a high volume, low differential pressure mode to circulate feedstock through the process. After the bottom chamber is filled with product, the process is isolated, the pressure in the pressure vessel(s) is reduced, and a circulation pump is used for moving feedstock and product at a pressure below the process operating pressure.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

The apparatus of the present invention is a feedstock fluid and product fluid system permitting operation of a process at a substantially constant process operating pressure. Several embodiments from a single pressure vessel to a plurality of pressure vessels, and a plurality of pressure vessels with a working fluid are further described below.

SINGLE PRESSURE VESSEL SYSTEM

Figure 1:
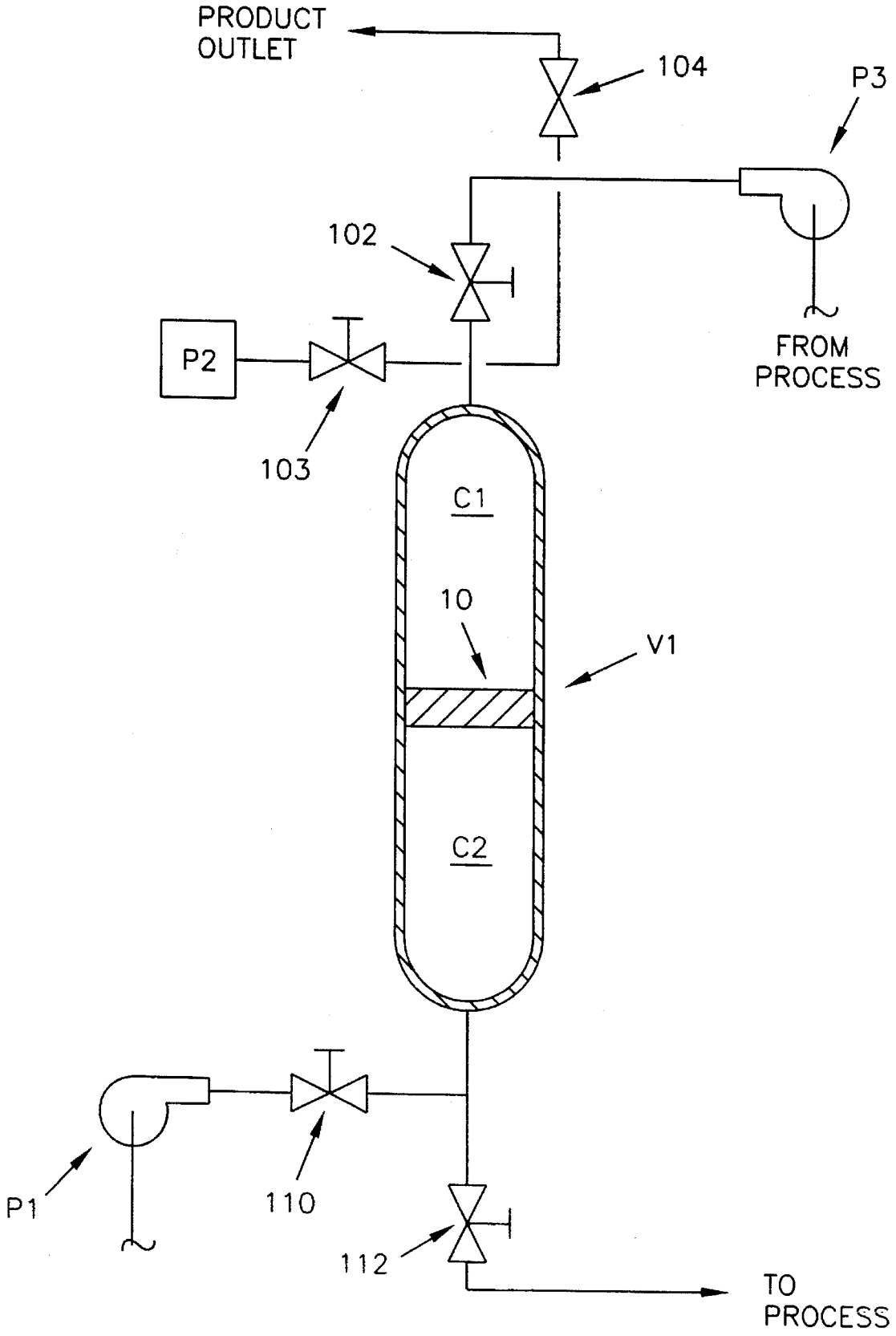
FIG. 1 is a schematic of a single pressure vessel system.
Figure 1A:
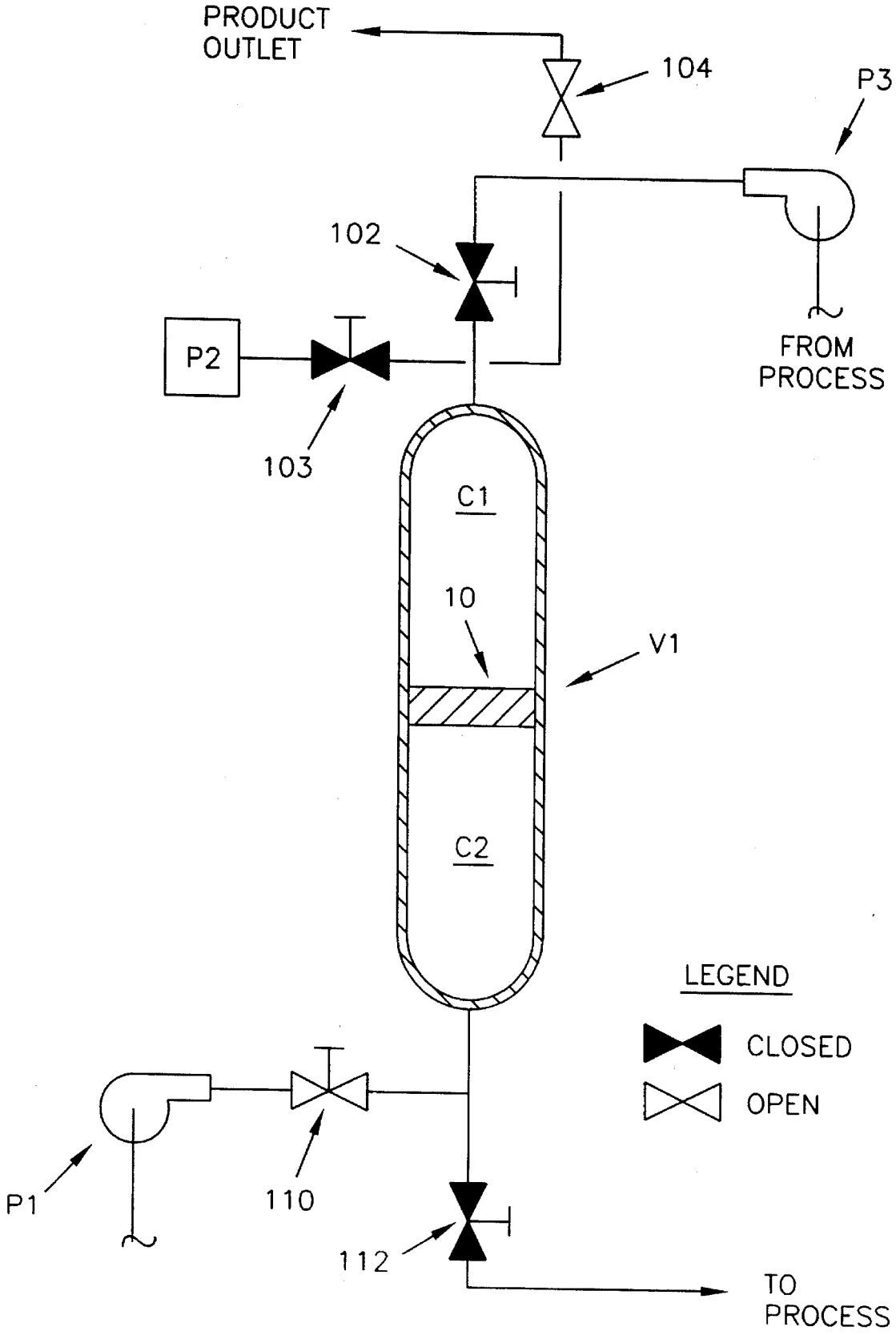
FIG. 1*a* is schematic of a single pressure vessel system undergoing feedstock loading.

An embodiment of the apparatus of the present invention is shown in FIG. 1. First pressure vessel V1 contains a separator 10 defining two chambers within the first pressure vessel V1. The separator 10 slideably seals the two chambers. In first pressure vessel V1, the two chambers are a first chamber C1 and a second chamber The separator 10 may be any separator capable of preventing intermingling of fluids on both sides of the separator. For example, the separator 10 may be a rolling bladder 10*a*, a bellows 10*b*, or a sliding piston 10*c* with ring seals 10*c*1, as illustrated in FIGS. 1*d*, 1*e*, and 1*f*. In harsh chemical environments, seals, piston, bladder or bellows materials may be Kalrez, Kevlar which are made by E. I. DuPont de Nemours. Separator materials may also be metals, rubbers, or polymers depending upon the chemical activity of the feedstock and product. In the event of a process upset, for example a leak, the separator 10 may be subjected to a pressure differential in excess of its capacity. This excess pressure differential condition may be avoided either by passive or active controls. Passive controls include rupture discs and relief valves that may be placed on a separator, especially a piston-type separator. Active controls include automated pressure sensitive feedback control circuits resulting in appropriate control valve operation to relieve the excess pressure differential.

Two pumps (P1 and P3) are used corresponding to two modes of pumping. As used herein, the term pump may refer to one or a plurality of pumps for a particular pumping mode. Any type of pump may be used that is appropriate for the fluid being pumped and the specified process pressure, for example positive displacement, centrifugal, reciprocating, or a combination thereof. A pressurizer P2 is used to maintain a process pressure. Any type of pressurizer may used, for example a hydraulic amplifier either single phase or multi-phase, or a pump. The term pressurizer may refer to one or a plurality of pressurizers.

A feedstock pump P1 is used for admitting a high volume flow low differential pressure charge of a feedstock fluid, that is substantially incompressible, into the second chamber C2 adjoining the first chamber C1. By displacement, any product in chamber C1 is moved through valve 104 to the product outlet.

A pressurizer P2 is used for maintaining a process pressure. If the pressurizer P2 is a pump, then it is used for admitting a low volume flow high differential pressure charge of a pressurizing fluid into the first chamber C1 and into the top chamber C3. Because the product is substantially incompressible and the feedstock is also substantially incompressible, pressurization of the product in the first chamber C1 to a process operating pressure results in pressurization of the feedstock in the second chamber C2 so that the entire first pressure vessel V1 is then pressurized.

A circulating pump P3 is used for moving product and thereby moving feedstock to the process at the process operating pressure. Alternatively, circulating pump P3 may be placed on a process feedstock line downstream of valve 112. Because the circulating pump P3 operates substantially at the process pressure, it may be sized to overcome only the flow resistance through the feedstock fluid and product fluid system and the process. It need not have capacity to bring the system up to the process pressure.

First valves are for isolating the product outlet (valve 102 and valve 204) and for isolating the feedstock pump from the pressure vessels (valve 110) after the first pressure vessel V1 receives a charge of feedstock. Isolation of the first valves permits the first pressure vessel V1 to be pressurized to the process operating pressure.

A second valve (valve 112) is for permitting flow of feedstock through the process.

In operation, a process is operating at process pressure and depletes a feedstock supply. A procedure to load feedstock is illustrated in FIG. 1*a*. Valve 102, valve 103 and valve 112 are closed isolating first pressure vessel V1 from the process pressure. First chamber C1 contains product from the process, and second chamber C2 contains unused feedstock. Feedstock pump P1 is started and valve 104 is opened as well as valve 110. As feedstock is pumped into the second chamber C2, product is moved through valve 104 and the separator 10 moves toward the top of first pressure vessel V1.

Figure 1B:
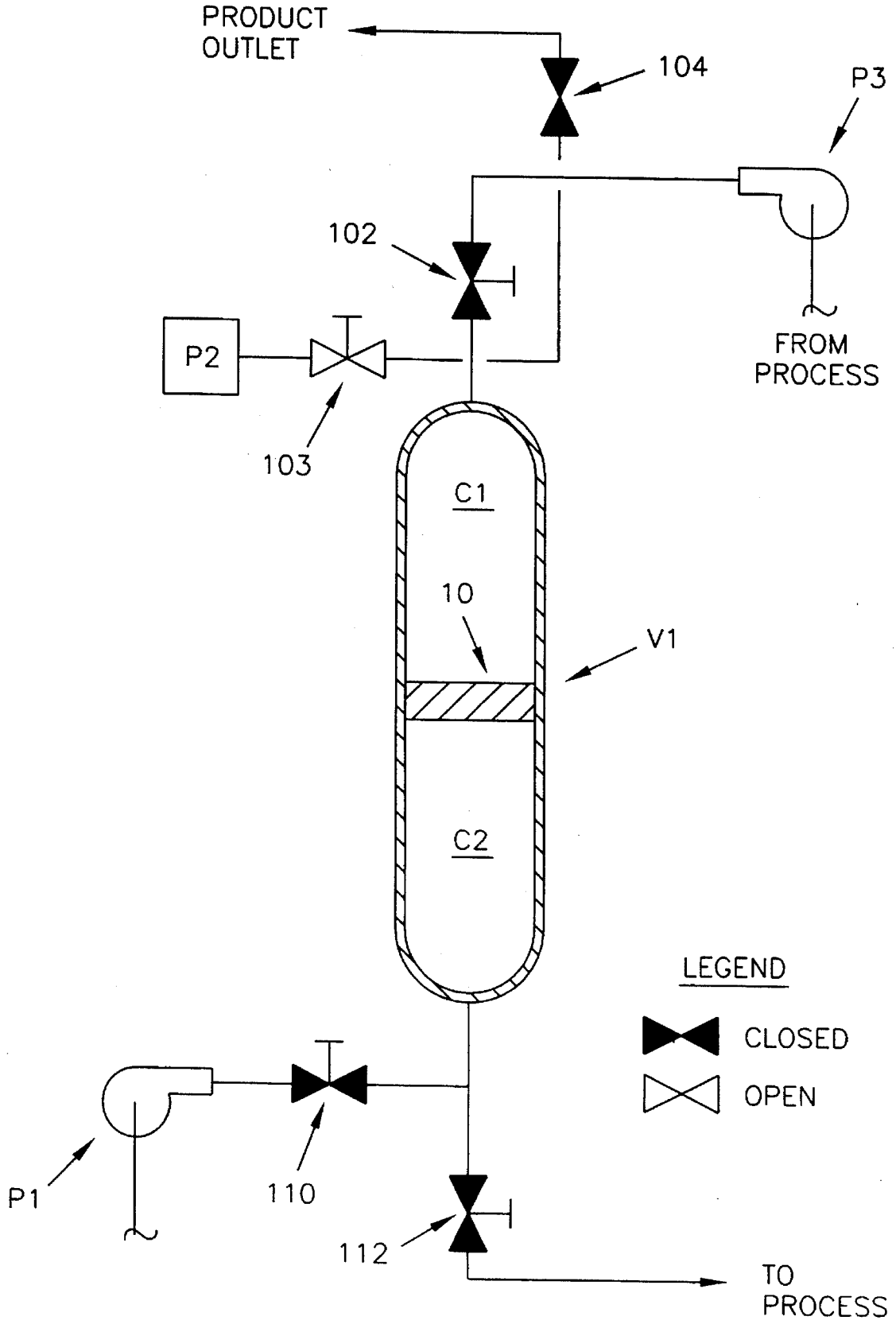
FIG. 1*b* is schematic of a single pressure vessel system undergoing pressurization.

After feedstock loading and product removal, the first pressure vessel V1 is pressurized as shown in FIG. 1*b*. Valve 104 and valve 110 are closed, and valve 103 is opened. Pressurizer P2 is used to pressurize first pressure vessel V1 to the process pressure.

Figure 1C:
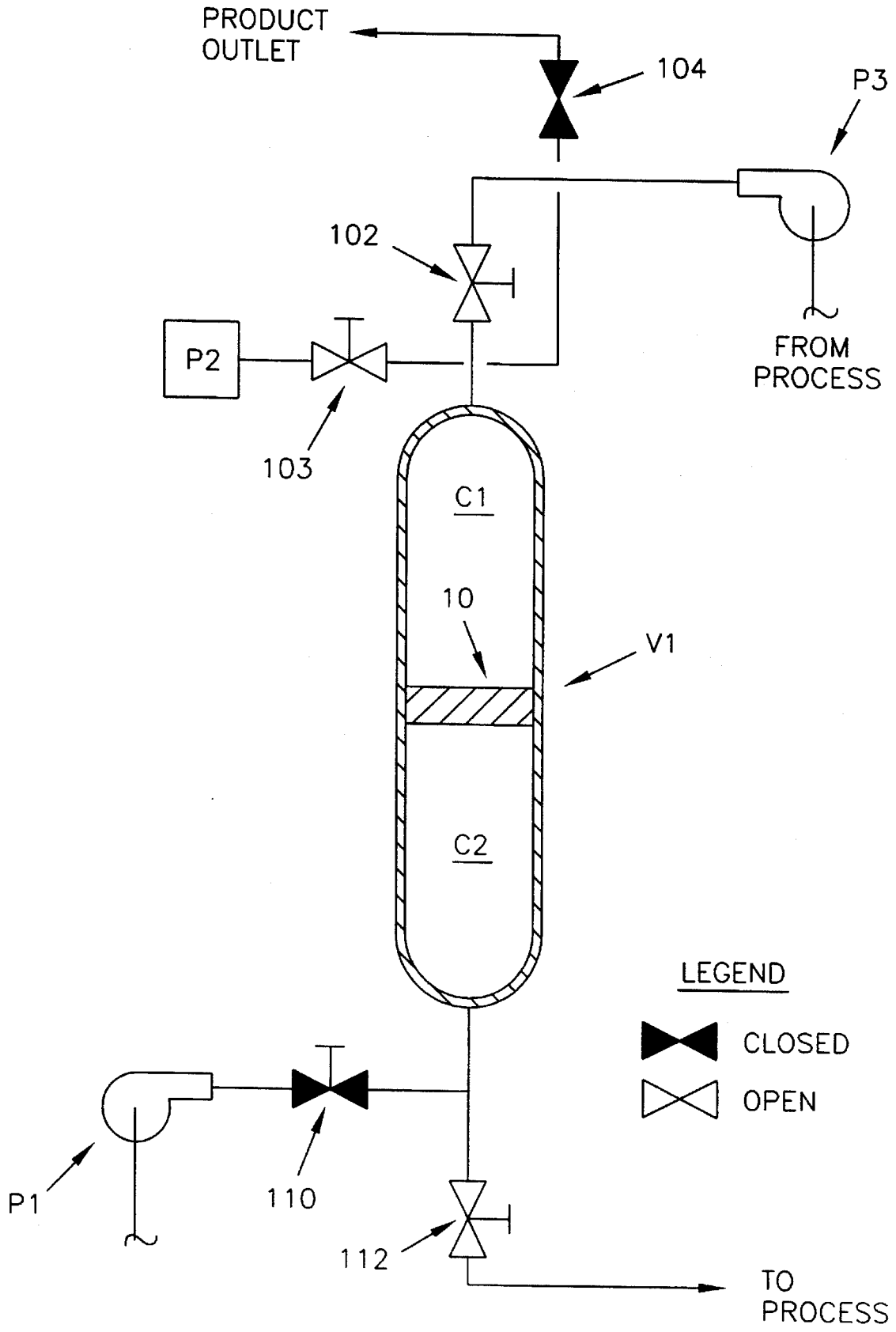
FIG. 1*c* is schematic of a single pressure vessel system undergoing process pressure operation.
Figure 1D:
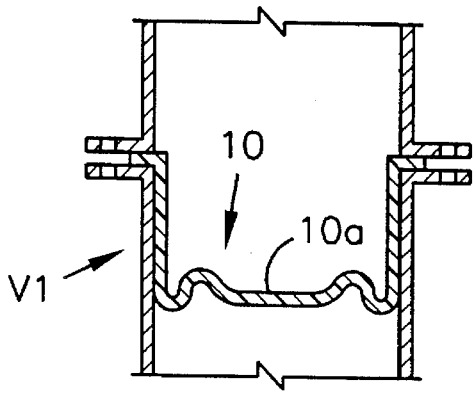
FIG. 1*d* is a cross-section of a bladder separator.
Figure 1E:
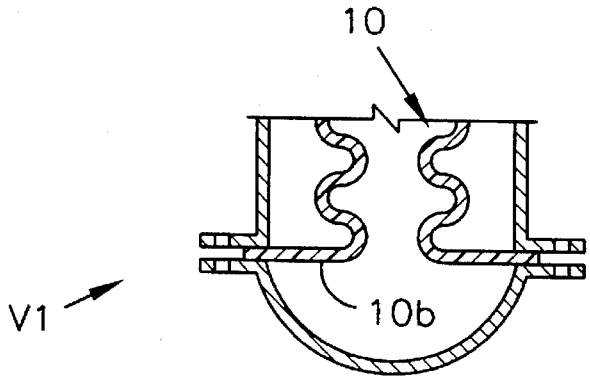
FIG. 1*e* is a cross-section of a bellows separator.
Figure 1F:
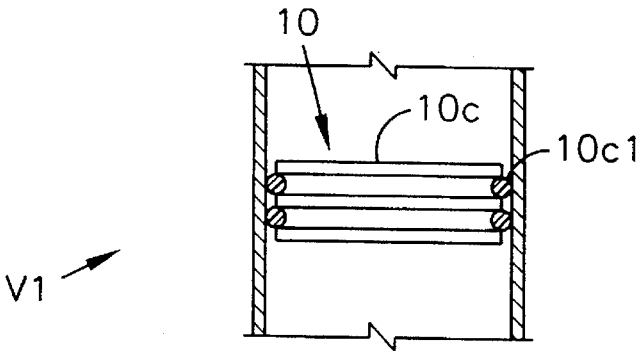
FIG. 1*f* is a cross-section of a piston separator.

Upon reaching process pressure, process pressure operation is begun as shown in FIG. 1*c*. Valve 102 and valve 112 are opened permitting circulating pump P3 to move product into first chamber C1 and feedstock from second chamber C2. When the process pressure operation is completed as indicated by depletion of feedstock, the procedure of feedstock loading is repeated.

It will be apparent to those skilled in the art of chemical processing that the process is idle during feedstock loading. Hence, a further embodiment employing at least a second pressure vessel is described below.

PAIR OF PRESSURE VESSELS SYSTEM

Figure 2:
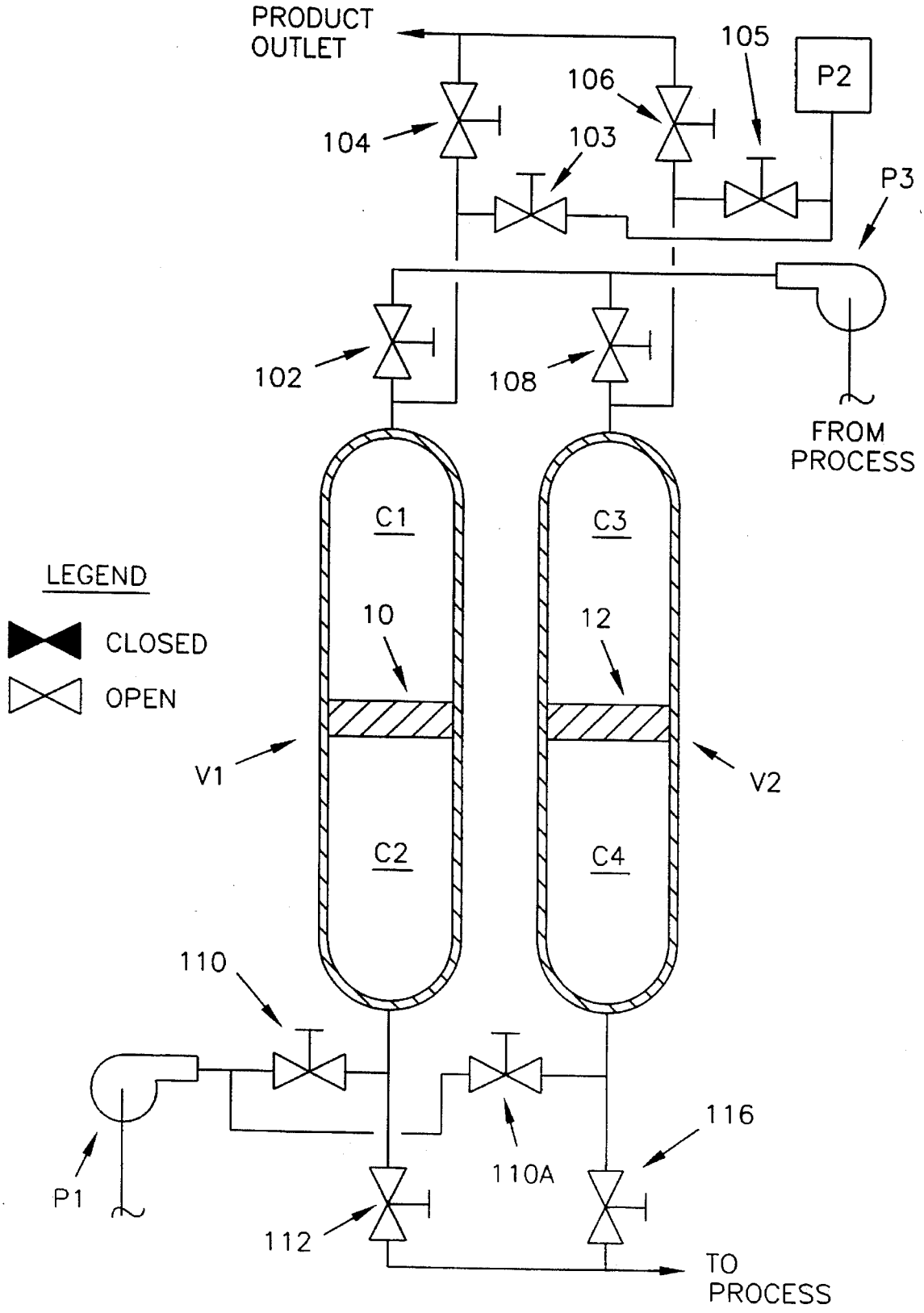
FIG. 2 is a schematic of a pair of pressure vessels system.

The process idle time may be avoided by employing at least a second pressure vessel as shown in FIG. 2. The first pressure vessel V1 is plumbed and operated as described above. The addition of the second pressure vessel V2 permits feedstock loading of the second pressure vessel V2 while the first pressure vessel V1 is under process pressure operation. The second pressure vessel V2 contains a second separator 12 defining a top chamber C3 and a bottom chamber C4 within the second pressure vessel V2. The second separator 12 may be similar or different from the separator 10.

Figure 2A:
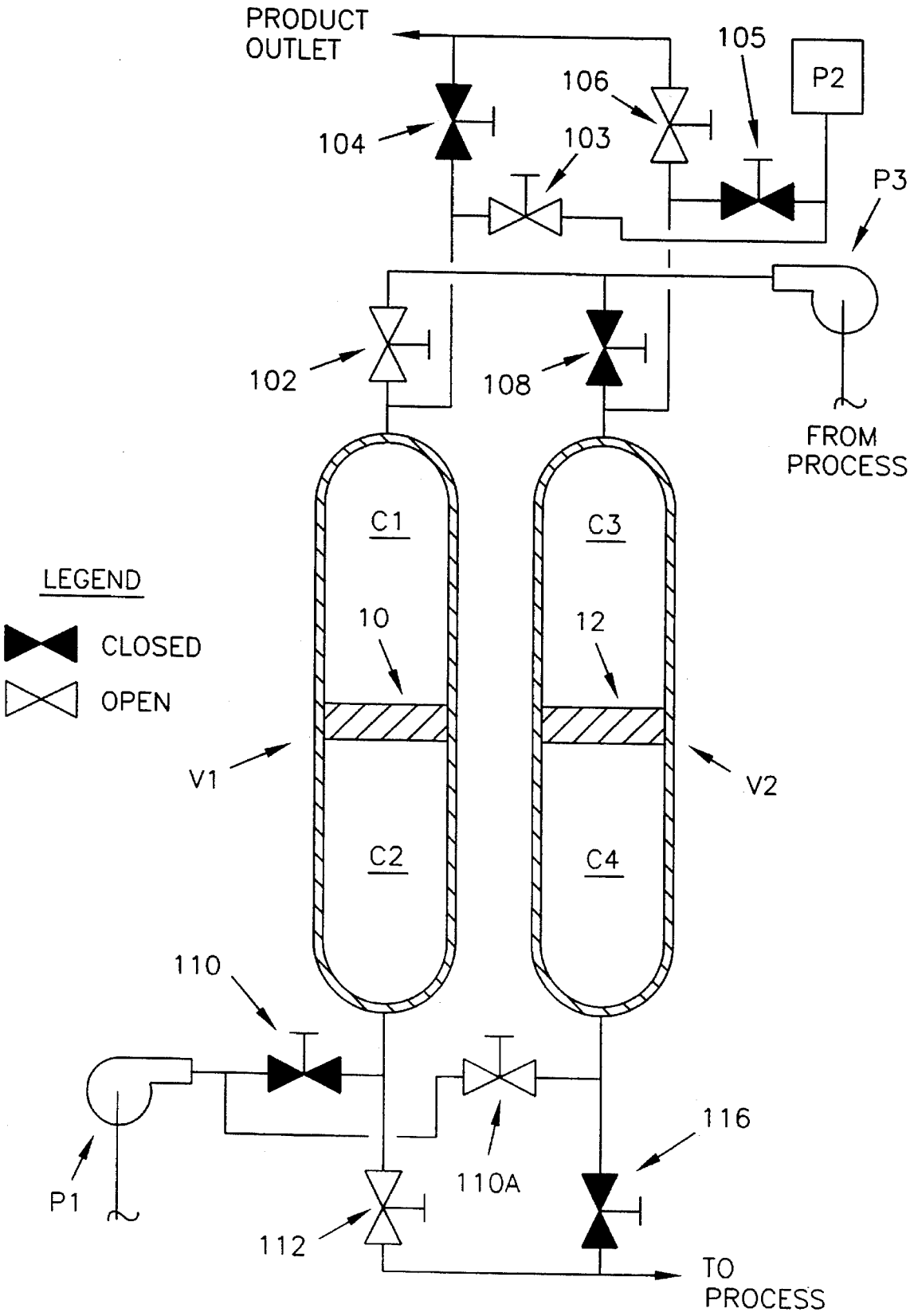
FIG. 2*a* is schematic of a pair of pressure vessels system undergoing simultaneous feedstock loading and process pressure operation.

Specifically with reference to FIG. 2*a*, when first vessel V1 is under process pressure operation, valve 104 and valve 110 are closed, while valve 102, valve 103 and valve 112 are open. Simultaneously, the second vessel V2 is under feedstock loading with valve 106 and valve 110A open while valve 105, valve 108 and valve 116 are closed.

Upon depletion of feedstock from first pressure vessel V1, second chamber C2, the first pressure vessel V1 is valved from process pressure operation to feedstock loading as previously described for single first pressure vessel operation, and the second pressure vessel V2 is valved from feedstock loading to process pressure operation as previously described for single first pressure vessel operation, with much less time between batches than for the single pressure vessel operation.

Again, it will be apparent to those skilled in the art of chemical processing that a limitation of the afore-mentioned embodiments is that they may be limited to certain processes because of the possibility of intermingling of product and feedstock, or because of heat transfer across the separator between feedstock and product. Accordingly, there is further described an embodiment of the present invention utilizing at least one pair of pressure vessels and a working fluid.

PAIR OF PRESSURE VESSELS SYSTEM WITH WORKING FLUID

Figure 3:
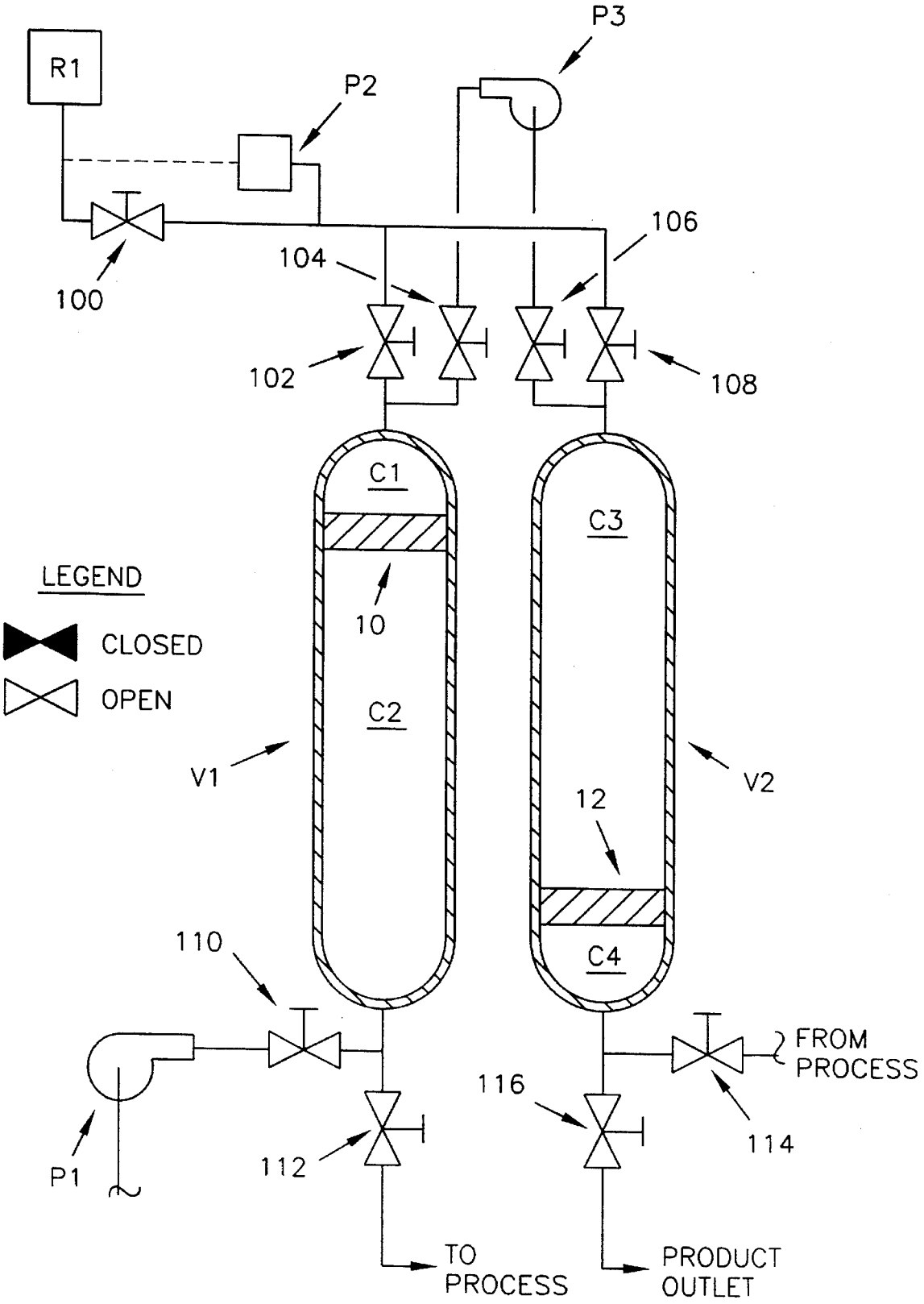
FIG. 3 is a schematic of a pair of pressure vessels system with a working fluid.

Referring now to FIG. 3, pressure vessel V1 and pressure vessel V2 are a pair of pressure vessels. Each pressure vessel contains a separator defining two chambers within each pressure vessel, the separator slideably sealing the two chambers.

A source R1 of working fluid, that is substantially incompressible is connected to both pressure vessels V1, V2. The working fluid may be any substantially incompressible liquid, but is preferably water. Working fluid is transferred from the source R1 to the first chamber C1, and/or the top chamber C3 via gravity feed or pumping. Working fluid is preferably transferred when the system is isolated from the process.

Pressurization of the first chamber C1 and the top chamber C3 may be done simultaneously or separately. The first chamber C1 and the top chamber C3 are pressurized to a pressure substantially equivalent to a process operating pressure. Because the working fluid is substantially incompressible and the feedstock is also substantially incompressible, pressurization of the working fluid in the first chamber C1 results in pressurization of the feedstock in the second chamber C2 so that the entire first pressure vessel V1 is then pressurized. The bottom chamber C4 is used to collect reaction product that is substantially incompressible, so the pressurization of the second pressure vessel V2 is similar to that of the first pressure vessel V1.

If pressurizer P2 is a pump, then it may use working fluid from source R1 as indicated by the broken line.

In this embodiment having a working fluid, circulating pump P3 is in direct contact with working fluid and does not contact product.

First valves are for isolating the working fluid reservoir R1 (valve 100, valve 102, and valve 108) and for isolating the feedstock pump from the pressure vessels (valve 110 and valve 116) after the first pressure vessel V1 receives a charge of feedstock. Isolation of the first valves permits the pressure vessels to be pressurized to the process operating pressure.

Second valves are for permitting flow of feedstock through the process (valve 112) from one of the pressure vessels and permitting flow of product back to the other of the pressure vessels (valve 114). Second valves also include valve 104 and valve 106 permitting flow of working fluid as feedstock and product flow.

In operation, feedstock loading (see FIG. 3*a*) is accomplished by closing valve 104, valve 106, valve 112, and valve 114 thereby isolating the process from the system. Valve 110, valve 116, valve 102, and valve 108 are opened while valve 100 is closed. Pressurizer P2 is turned off, or alternatively valved off as illustrated previously. Feedstock pump P1 moves feedstock into second chamber C2 while working fluid is moved from first chamber C1 to top chamber C3 thereby moving product from bottom chamber C4.

After feedstock loading, system pressurization (see FIG. 3*b*) is done by closing valve 110 and valve 116. Pressurizer P2 is either turned on or valved in to pressurize the first pressure vessel V1 and the second pressure vessel V2.

Upon system pressurization, process pressure operation is initiated (see FIG. 3*c*) by closing valve 102 and valve 108 then opening valve 104, valve 106, valve 112 and valve 114.

It will be apparent to one skilled in the art of batch processing that a single pair pressure vessel system with working fluid has the limitation of leaving the batch process idle during filling and emptying of the pressure vessels of feedstock and product respectively. In addition, the batch feedstock and product must be handled dependently. However, use of the working fluid limits exposure of pumping equipment to feedstock or product. Another advantage is that during pressure relief, working fluid may flow through an orifice instead of feedstock or product that may contain particles that could erode a depressurization orifice. Accordingly, a multi-pair pressure vessel system with working fluid is described permitting less idle time of the batch process and permitting independent handling of feedstock and product.

MULTI-PAIR PRESSURE VESSELS SYSTEM WITH WORKING FLUID

Figure 3A:
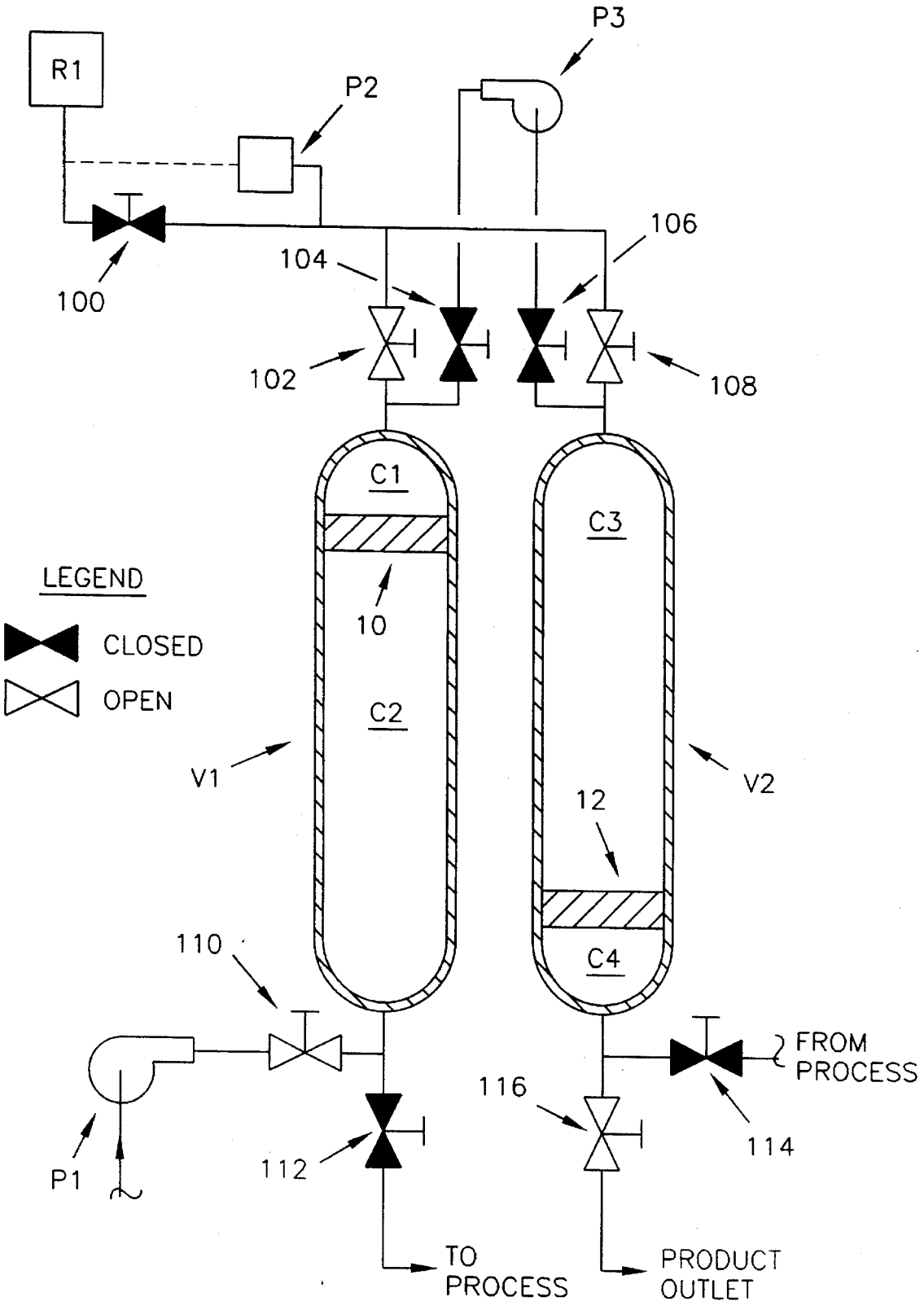
FIG. 3*a* is schematic of a pair of pressure vessels system with a working fluid undergoing feedstock loading.
Figure 3B:
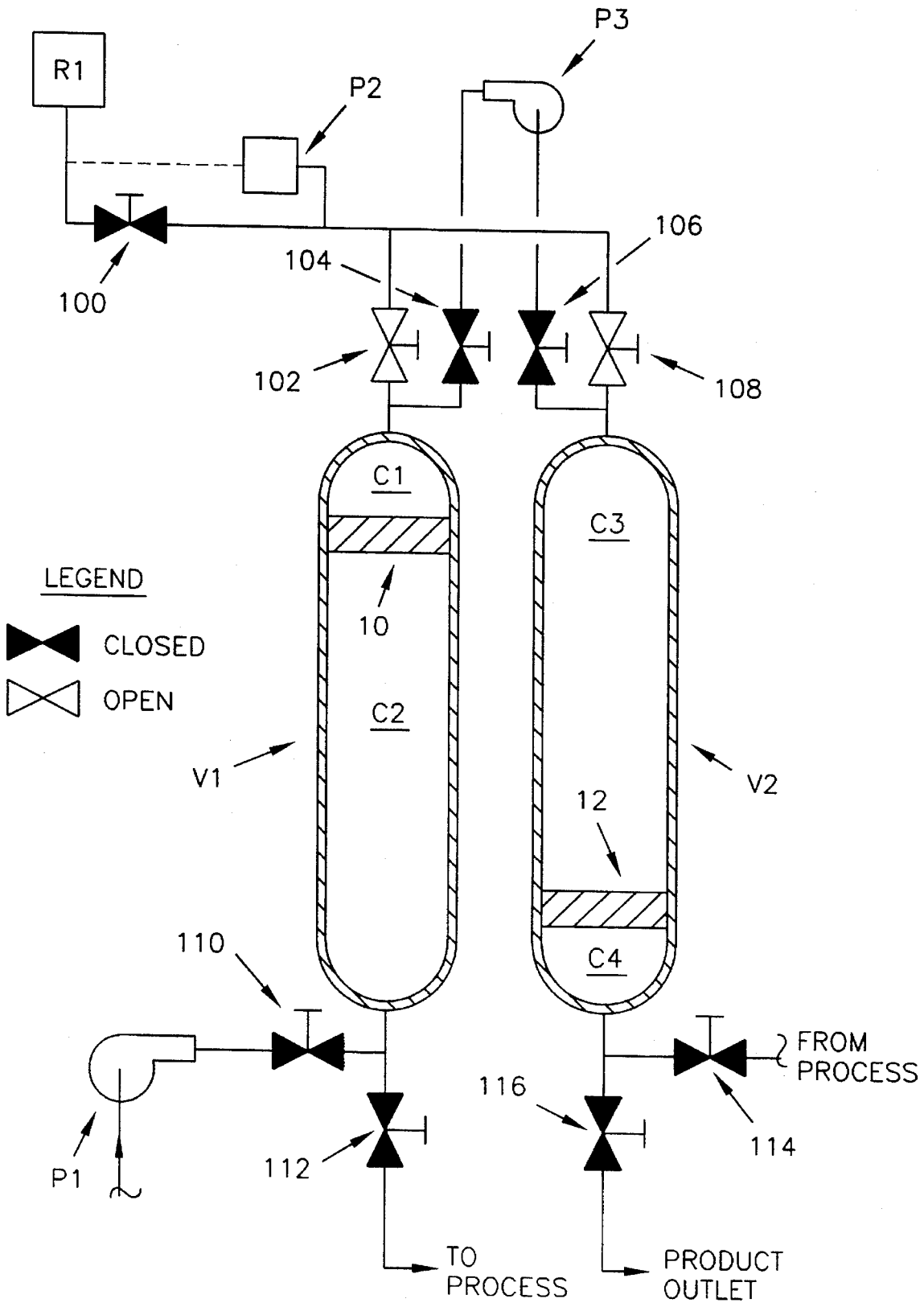
FIG. 3*b* is schematic of a pair of pressure vessels system with a working fluid undergoing pressurization.
Figure 3C:
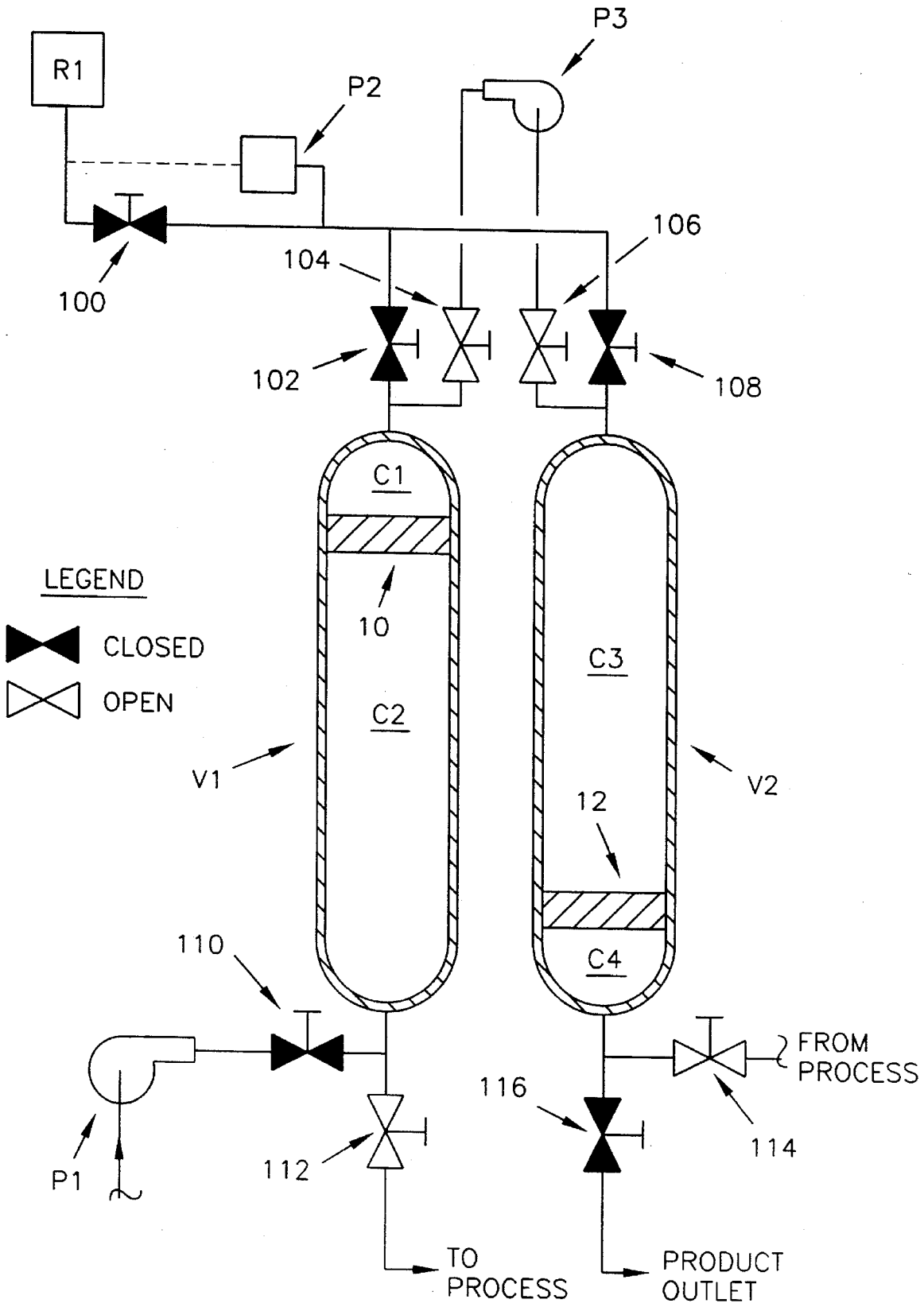
FIG. 3*c* is schematic of a pair of pressure vessels system with a working fluid undergoing process pressure operation.
Figure 4:
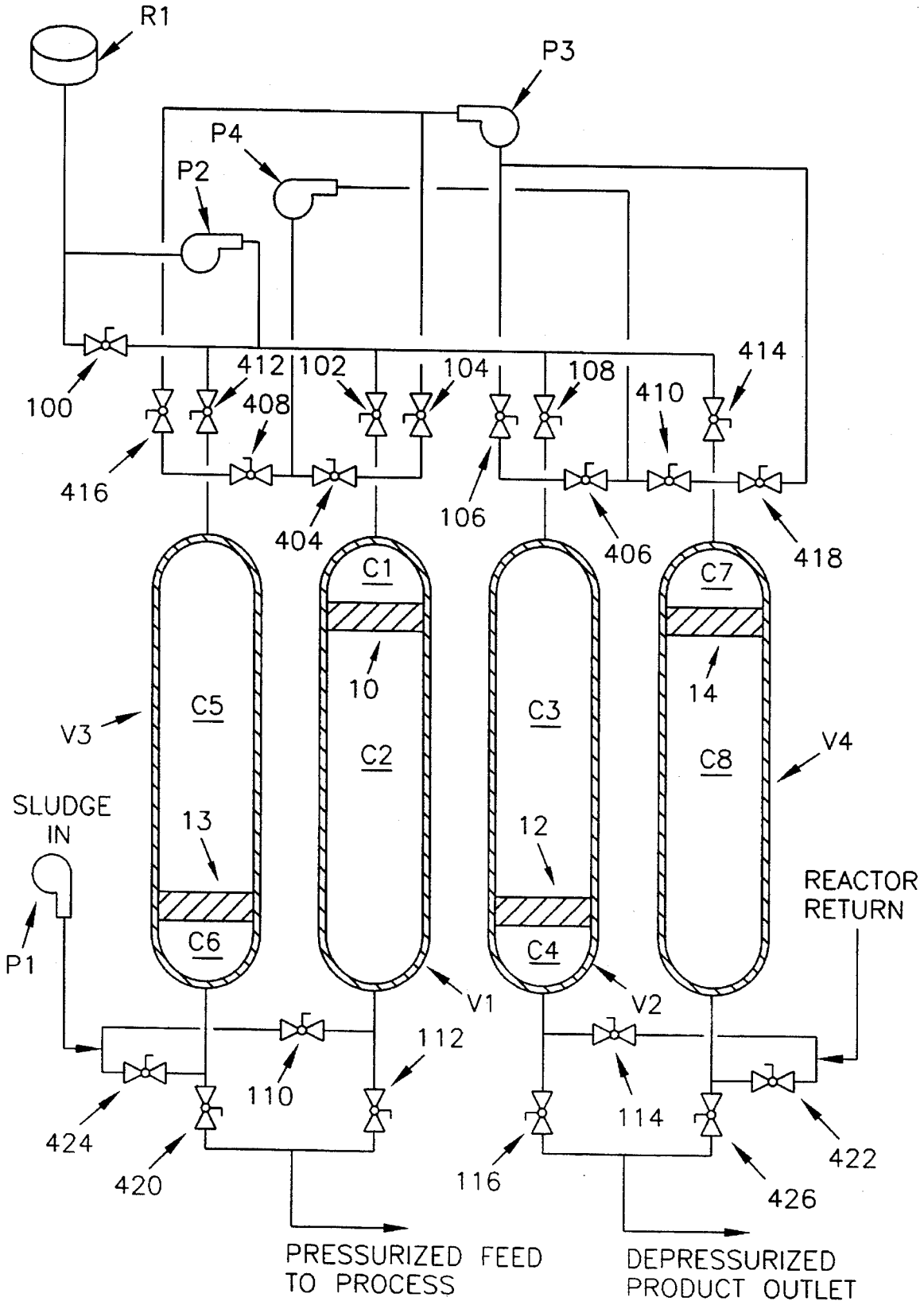
FIG. 4 is a schematic of a multi-pair pressure vessel system with a working fluid.
Figure 4A:
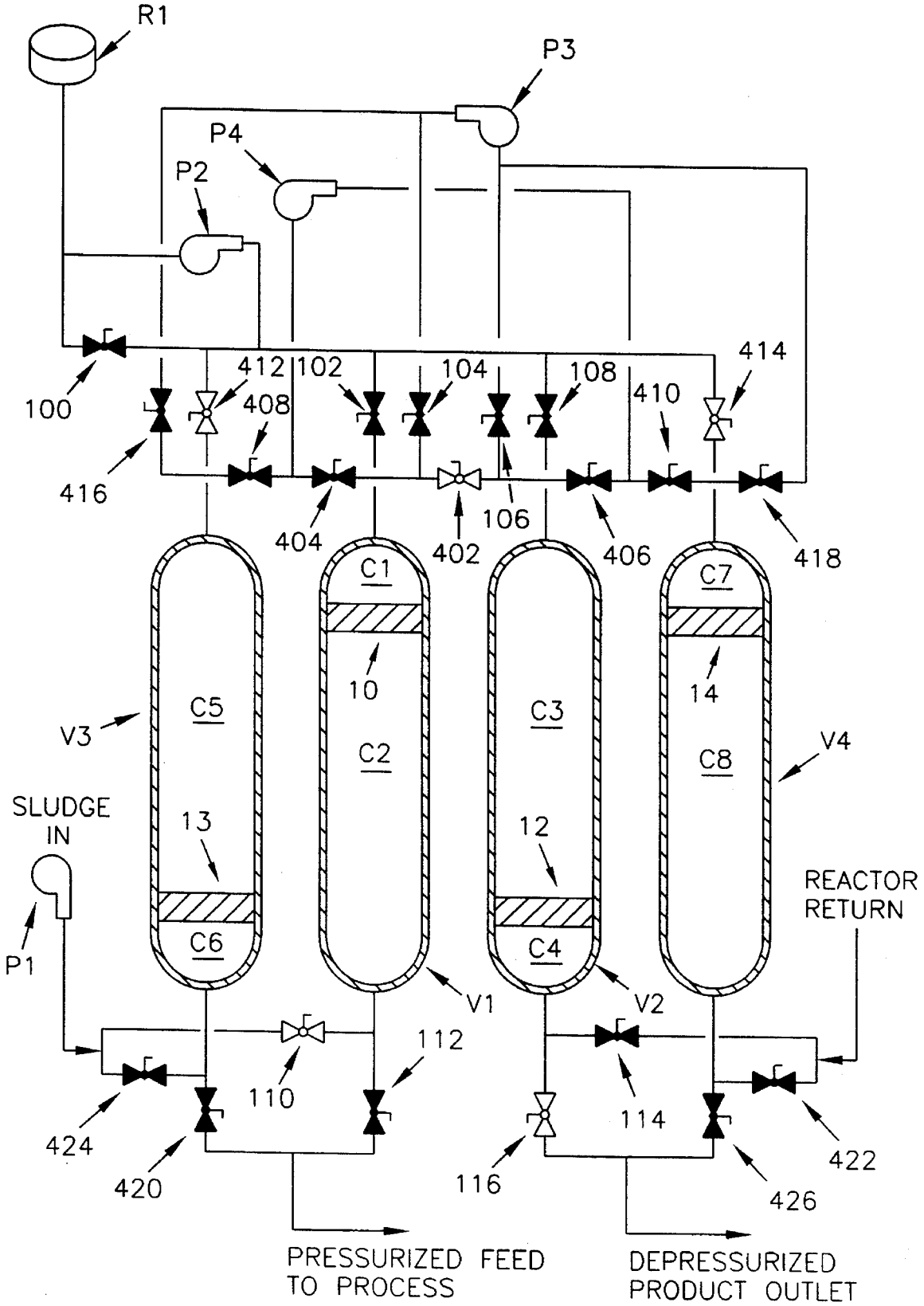
FIG. 4*a* is schematic of a multi-pair pressure vessel system with a working fluid undergoing feedstock loading via a feedstock pump.

A multi-pair pressure vessel system is shown in FIG. 4. First pressure vessel V1 and second pressure vessel V2, and reservoir R1 along with pumps P1, P3, pressurizer and together with valves 100, 102, 104, 106, 108, 110, 112, 114, and 116 are substantially the same and are operated substantially the same as previously described with respect to FIGS. 3, 3*a*, 3*b*, and 3*c*.

Returning now to FIG. 4, a feedstock vessel V3 and a product vessel V4 are added having separators 13 and 14, as well as a pump P4 and additional valves. Again, separators 13 and 14 may be similar or different from separator 10. Operations of feedstock loading, pressurization, and process pressure operation are substantially the same as previously described with respect to a pair of vessels with a working fluid. However, by permitting communication between the first vessel V1 and the feedstock vessel V3, the rate of feedstock flow to the process can be independent of the rate of product flow from the process. By operating first and second vessels V1, V2 as a pair as previously described for a pair of pressure vessels with a working fluid, and by operating the third and fourth vessels V3, V4 as a second pair, the first and second pairs can be operated alternately so that the process is in substantially continuous operation.

An operation of the multi-pair pressure vessels with working fluid is described. Initially, the system is substantially at atmospheric pressure, all valves are closed, and first pressure vessel V1, first chamber C1 is filled with working fluid and second chamber C2 is depleted of feedstock with separator 10 near the bottom of the first pressure vessel V1. Additionally, the second pressure vessel V2, contains working fluid in top chamber C3, but is filled with product in bottom chamber C4, with separator 12 near the top of the second pressure vessel V2. The third pressure vessel V3, top chamber C5 contains working fluid while bottom chamber C6 is substantially filled with feedstock. The fourth pressure vessel V4, top chamber C7 is filled with working fluid, while the bottom chamber C8 is substantially empty of product.

Figure 4B:
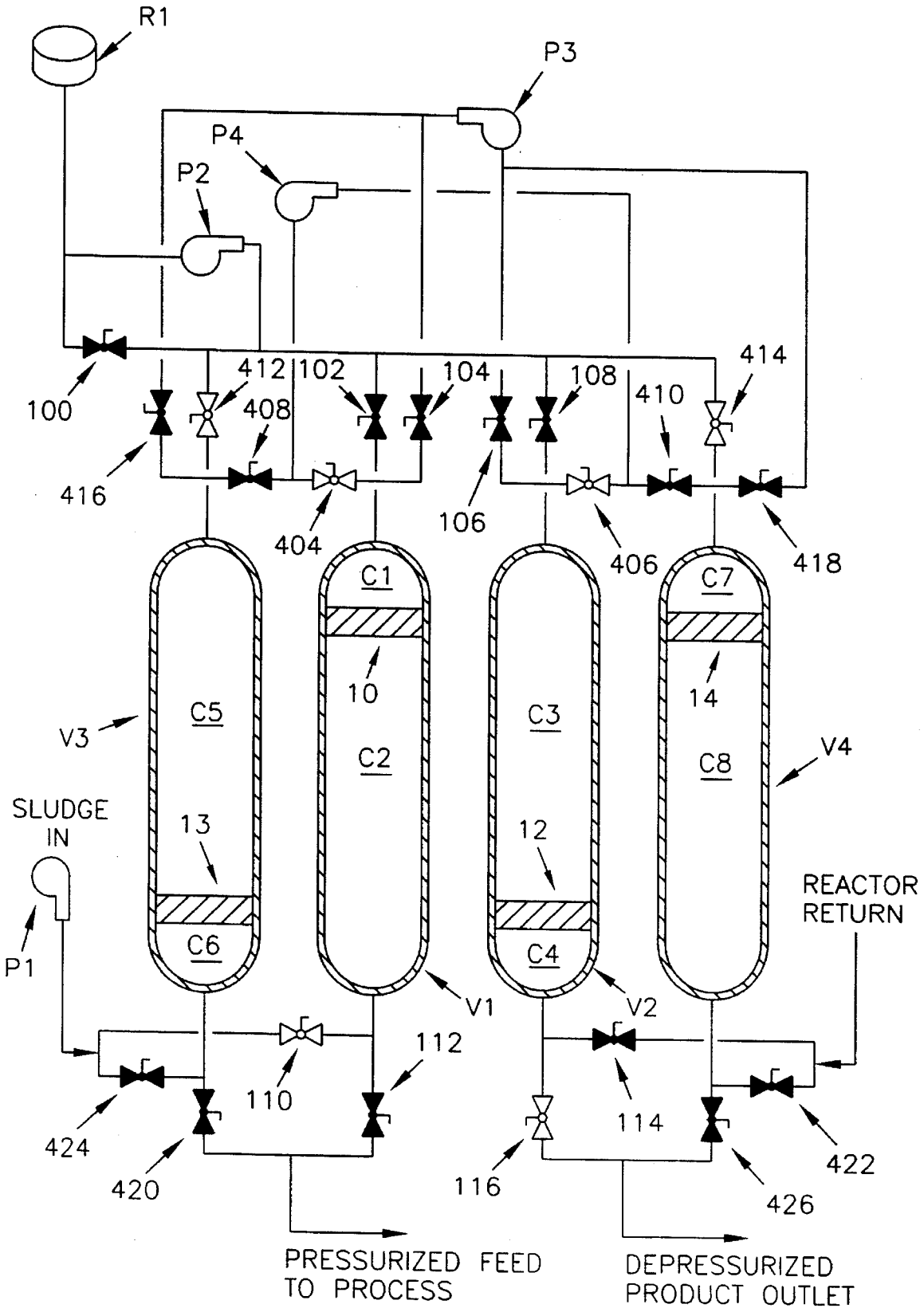
FIG. 4*b* is schematic of a multi-pair pressure vessel system with a working fluid undergoing feedstock loading via a feedstock pump and a working fluid pump.

The first step is feedstock loading of the first pressure vessel V1 and product removal from the second pressure vessel V2 substantially as previously described for the single pair pressure vessels with working fluid (FIG. 3 and 3*a*). However, in the multi-pair system, valve 102 and valve 108 are closed and valve 402 is open. Valve 404 and valve 406 are also closed. Alternatively, as shown in FIG. 4*b*, lacking valve 402, valves 404, 406 are open and valves 408, 410 are closed and pump P4 is relied upon rather than only pump P1 for transfer of feedstock and product. Simultaneously, the third and fourth pressure vessels V3, V4 are pressurized by pressurizer P2 with valves 412, 414 open.

Figure 4C:
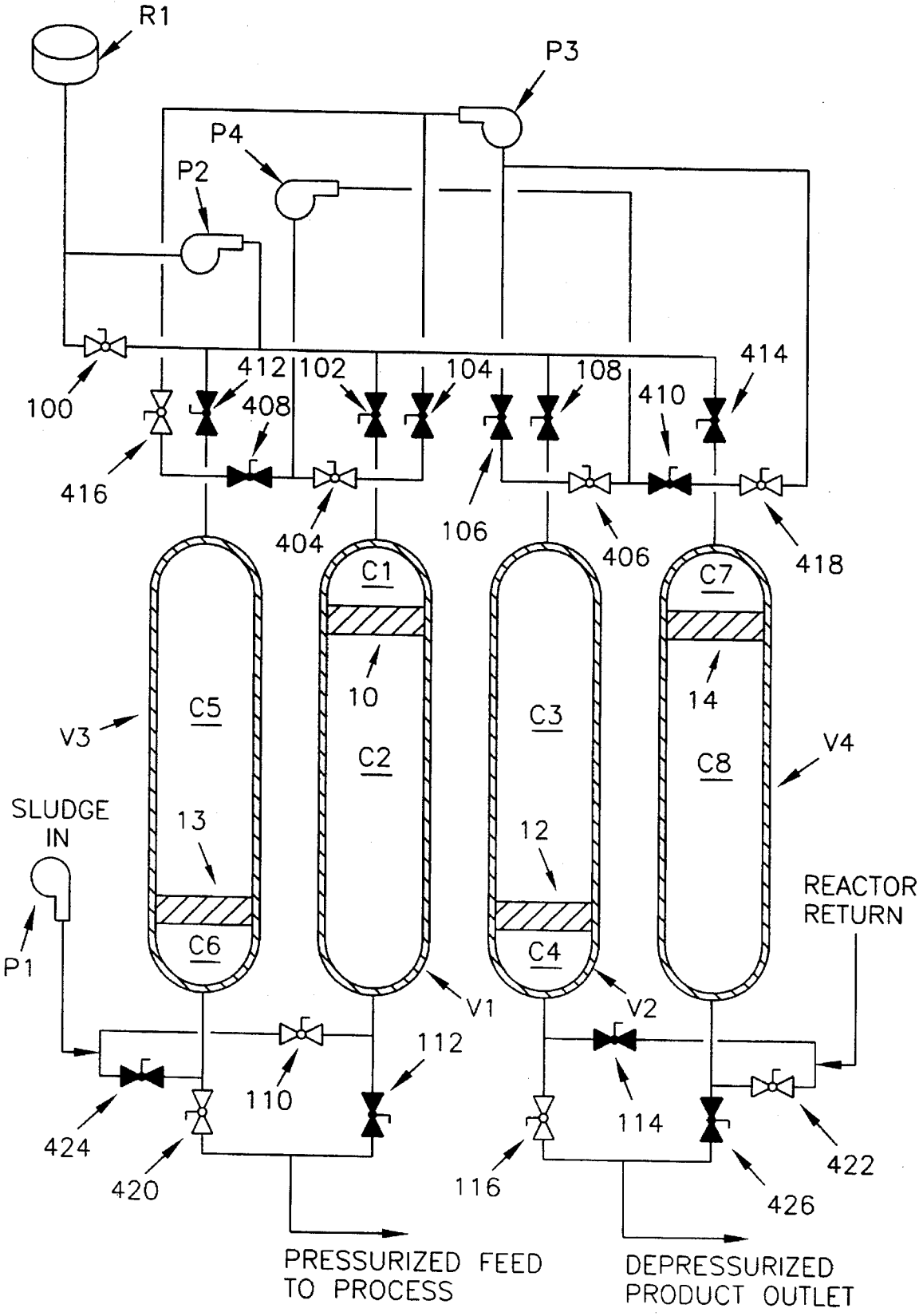
FIG. 4*c* is schematic of a multi-pair pressure vessel system with a working fluid undergoing pressurization.

Further, while the first and second pressure vessels V1, V2 are undergoing feedstock loading, after pressurization of the third and fourth pressure vessels V3, V4, process pressure operation is begun (FIG. 4*c*). Valve 412 and valve 414 are closed, and valves 416, 418 are opened to pump P3 to operate a process pressure. Additionally, valve 420 and valve 422 are opened.

Upon completion of feedstock loading of the first and second pressure vessels V1, V2 and upon completion of the process pressure operation of the third and fourth vessels V3, V4, the procedures are then repeated for the respective vessel pairs.

PRESSURIZATION

In any embodiment of the present invention, the pressurization step may contain several substeps. Prior to valving to join a pressurized pressure vessel with the process, it is preferred to verify that the pressure within the pressurized pressure vessel is substantially the same as the process pressure. Substantially the same generally refers to pressures of about ±25% of process pressure, and preferably about ±10% of process pressure, and most preferably within about ±5% of process pressure. Pressure indicators may be of any type, but are preferably remotely readable, and more preferably remotely readable by a computer or electronic controller.

VALVES

Although single valves are shown in the drawings for ease of understanding, it will be apparent to those skilled in the art that there may be additional isolation valves in addition to the control valves. For example, a control valve may be surrounded by a pair of isolation valves and/or bypass valves to permit maintenance or replacement of the control valve. Check valves may be placed on one-way flow lines, for example pump outlet lines. Additional guages and guage isolation valves for monitoring operation may be used according to standard industry practice.

Control valves may be manually actuated or remotely actuated via electricity, pneumatics, or hydraulics. Further, a control system may be employed permitting remote actuation of valves and may permit unattended operation of the system through the use of computer controls with software instructions for sequential valve, pump and pressurizer operation.

EXAMPLE 1

A calculation was made to compare pumping energy between conventional feedstock handling and the pressure vessel(s) system of the present invention.

Based upon 600 dry ton/day of raw sludge with a typical 20% solids concentration, the feedstock of raw wet sludge amounts to about 3000 tons/day. Assuming that the present invention was used to introduce the raw wet sludge into a pressurized process and used to remove product from the pressurized process, Table 1 shows the sizes of vessels needed as a function of cycle time for hold-up for an eight vessel system.

TABLE 1

| Cycle Time (Minutes) | Pressure Vessel Size (cu.ft.) 5 | 10 | 15 |
|---|---|---|---|
| | 41 | 83 | 124 |

Pumping energy is compared in Table 2. Sludge flow of about 3000 tons/per day is approximately 500 gpm. Conventional practice is to provide a single pump or a plurality of pumps in parallel to handle pressurization and flow. A sludge process pressure of about 3500 psi is assumed. These parameters are shown in Table 2, followed by estimates of pump efficiency to obtain an annual energy consumption of about $13(10)^6$ kWhr/yr.

By using the present invention, only a small amount of liquid (0.1 gpm) is needed by the pressurizer P2 while the circulating pump P3 then only need operate over a much reduced differential pressure (50 psi) that is made up primarily of fluid friction losses in the piping and within the process. The fill pump, or feedstock pump P2 operates both at a reduced pressure differential and at a reduced absolute pressure. Use of the present invention results in an estimated 44 fold reduction in annual pumping energy compared to conventional pumping.

TABLE 2

Pumping Energy Comparison

| | Flow (gpm) | +e,cir (psi) | Theo. Pwr(Hp) | Efficiency (%) | Actual Pwr(Hp) | Ann.En (kWh) |
|---|---|---|---|---|---|---|
| Conventional | | | | | | |
| Pump | 500 | 3500 | 1020 | .70 | 1457 | $13(10)^6$ |
| Present Invention | | | | | | |
| Pressurizer (P2) | 0.1 | 3500 | 0.2 | .90 | 0.22 | |
| Fill Pump (P1) | 500 | 30 | 8 | .70 | 12 | |
| Circ. Pump (P3) | 500 | 50 | 15 | .70 | 21 | |
| TOTAL | | | | | 33.2 | $.3(10)^6$ |

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A feedstock fluid and product fluid system permitting operation of a process at a substantially constant process operating pressure, said system comprising:

(a) at least one pressure vessel having a separator defining a first chamber and a second chamber within said pressure vessel, said separator slideably sealing the first and second chambers;

(b) a feedstock pump for admitting a high volume flow low differential pressure charge of a feedstock fluid, that is substantially incompressible, into the second chamber;

(c) a pressurizer for admitting a low volume flow high pressure differential charge of a product into the first chamber and for pressurizing to a pressure substantially equivalent to a process operating pressure;

(d) a circulating pump for moving feedstock to the process and moving product from the process at the process operating pressure;

(e) first valves for isolating the at least one pressure vessel and the pressurizer from the process, from the feedstock pump and from the circulating pump thereby permitting the pressure vessel to be pressurized to the process operating pressure; and (f) second valves for permitting flow of feedstock through the process from the second chamber of the pressure vessel and permitting flow of product either back to the first chamber of the pressure vessel or back to the second pressure vessel.

2. The system as recited in claim 1, wherein said second pressure vessel undergoes process pressure operation while the first pressure vessel undergoes feedstock loading.

3. The system as recited in claim 1, further comprising a working fluid within the first chambers of said pressure vessels, and a working fluid reservoir.

4. The system as recited in claim 1, further comprising:

a third and fourth pressure vessel comprising a second pair of pressure vessels.

5. The system as recited in claim 3, wherein the working fluid is water.

6. A feedstock fluid and product fluid system permitting operation of a process at a substantially constant process operating pressure, said system comprising:

(a) at least one pair of pressure vessels wherein each pressure vessel contains a separator defining two chambers within each pressure vessel, said separator slideably sealing the two chambers;

(b) a working fluid reservoir, said working fluid, substantially incompressible, placed within a first chamber of one of the pressure vessels;

(c) a feedstock pump for admitting a high volume low pressure charge of a feedstock fluid, that is substantially incompressible, into a second chamber adjoining the first chamber;

(d) a pressurizer for admitting a low volume high pressure charge the working fluid to a pressure substantially equivalent to a process operating pressure;

(e) a circulating pump for moving working fluid and thereby moving feedstock to the process and moving product from the process at the process operating pressure;

(f) first valves for isolating the working fluid reservoir and second pump from the pressure vessel permitting the pressure vessels to be pressurized to the process operating pressure; and (g) second valves for permitting flow of feedstock through the process from one of the pressure vessels and permitting flow of product back to the other of the pressure vessels.

7. The system as recited in claim 6, further comprising:

a third and a fourth pressure vessel comprising a second pair of pressure vessels.

8. The system as recited in claim 6, wherein said working fluid is water.

9. A method of operating a batch process at a substantially constant process operating pressure while introducing feedstock and extracting product at a reduced pressure below the batch process operating pressure, said method comprising the steps of:

(a) providing at least one pressure vessel wherein said at least one pressure vessel each has a separator dividing the at least one pressure vessel into two chambers wherein the separator is moveable permitting variable amounts of fluid in the two chambers;

(b) filling a second chamber with a feedstock that is substantially incompressible;

(c) filling a first chamber with a product that is substantially incompressible;

(d) isolating the pressure vessel then admitting a low volume high pressure charge of working fluid into the pressure vessel with a pressurizer to bring the pressure vessel to a pressure substantially equivalent to a process operating pressure; and (e) isolating the pressurizer then opening the pressure vessel, now filled and pressurized, to a second pump for circulating feedstock and opening the pressure vessel to the process thereby moving feedstock to the process and moving product from the process at the process operating pressure.

10. A method of operating a batch process at a substantially constant process operating pressure while introducing feedstock and extracting product at a reduced pressure below the batch process operating pressure, said method comprising the steps of:

(a) providing at least one pair of pressure vessels wherein each pressure vessel has a separator dividing the pressure vessel into two chambers wherein the separator is moveable permitting variable amounts of fluid in the two chambers;

(b) filling a first chamber in one of the pressure vessels with a working fluid that is substantially incompressible and filling a second chamber with a feedstock fluid that is also substantially incompressible;

(c) filling a first chamber in the other of the pressure vessels with the working fluid;

(d) isolating the pair of pressure vessels then admitting a low volume high pressure charge of working fluid into the pressure vessels with a pressurizer to bring the pressure vessels to a pressure substantially equivalent to a process operating pressure; and (e) isolating the pressurizer then opening the pair of pressure vessels, now filled and pressurized, to a second pump for circulating working fluid and opening the pair to the process thereby moving feedstock to the process and moving product from the process at the process operating pressure.

* * * * *

UNITED STATES PATENT AND TRADEMARK OFFICE

CERTIFICATE OF CORRECTION

PATENT NO. : 5,533,868
DATED : 7/9/96
INVENTOR(S) : AG Fassbender

It is certified that error appears in the above-identified patent and that said Letters Patent is hereby corrected as shown below:

On the title page,item [54] please change "BATCH-WIRE" to --BATCH-WISE--.

In column 1, line 2 (Title), please change "BATCH-WIRE" to --BATCH-WISE--.

Signed and Sealed this

Thirteenth Day of May, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,533,868

DATED : July 9, 1996

INVENTOR(S) : Fassbender

It is certified that error appears in the above-identified patent and that said Letters Patent is hereby corrected as shown below:

In column 9, claim 2 , after the word "wherein" please replace "said" with –a–.

Signed and Sealed this

Sixteenth Day of December, 1997

Bruce Lehman

*Attest:*

BRUCE LEHMAN

*Attesting Officer*

*Commissioner of Patents and Trademarks*